US005359577A

United States Patent [19]

Hoshino et al.

[11] Patent Number: 5,359,577

[45] Date of Patent: Oct. 25, 1994

[54] ALARM CLOCK HAVING AN AMBIENT LIGHT DETECTOR

[75] Inventors: Yukari Hoshino; Takahiro Izukawa; Hirobumi Okuyama, all of Tokyo, Japan

[73] Assignee: Seikosha Co., Ltd., Japan

[21] Appl. No.: 115,472

[22] Filed: Sep. 1, 1993

[30] Foreign Application Priority Data

Sep. 3, 1992 [JP] Japan ..... 4-235967
Sep. 7, 1992 [JP] Japan ..... 4-238279

[51] Int. Cl.[5] ..... G04B 19/22; G04B 23/02

[52] U.S. Cl. ..... 368/67; 368/68; 368/72

[58] Field of Search ..... 368/67, 68, 72–74, 368/223, 227

[56] References Cited

U.S. PATENT DOCUMENTS

| | | | |
|---|---|---|---|
| 4,091,611 | 5/1978 | Fukuichi | 368/67 |
| 4,114,366 | 9/1978 | Benner et al. | 368/68 |
| 4,912,688 | 3/1990 | Sifert | 368/67 |
| 4,995,016 | 2/1991 | Vatanase | 368/67 |

OTHER PUBLICATIONS

Patent Abstracts of Japan, vol. 8, No. 6 (P-247) Jan. 12, 1984.

Patent Abstracts of Japan, vol. 5, No. 146 (P-80) Sep. 16, 1981.

*Primary Examiner*—Vit W. Miska
*Attorney, Agent, or Firm*—Bruce L. Adams; Van C. Wilks

[57] ABSTRACT

An alarm clock has an ambient light detector for controlling the illumination of a time displaying section. An alarm time which is selected by a user is stored in a memory. An alarm set switch is used to switch between alarm-on and alarm-off conditions. A photosensor detects the ambient light surrounding the alarm clock. The illumination of the displaying section is controlled so that the displaying section is illuminated only when the current time is within a predetermined time zone before the alarm time set by the user, the alarm set switch is in the alarm-on condition and the detected ambient light is below a predetermined level. The illumination of the displaying section is also controlled so that the display is illuminated while an alarm sound is being generated. The time at which the user switches the alarm set switch to the alarm-on condition can be stored, and the illumination of the displaying section is controlled so that the displaying section is illuminated after a predetermined amount of time has elapsed after the alarm set switch has been switched to the alarm-on condition.

13 Claims, 6 Drawing Sheets

ALARM CLOCK HAVING AN AMBIENT LIGHT DETECTOR

BACKGROUND OF THE INVENTION

The present invention pertains generally to an alarm clock. More particularly, the present invention pertains to an alarm clock having an ambient light detector for controlling the illumination of the alarm clock display.

Alarm clocks are well known timekeeping devices which generate an alarm sound at a preselected time of day. Generally, the alarm is sounded at a preselected time of day corresponding to the time at which a user must wake up from a night's sleep.

There are known alarm clocks which have a time displaying section that is illuminated only when an illumination switch is turned on. Thus, for example, if the illumination light bothers the user (such as when the user is trying to fall asleep), the illumination switch can be manually turned off to darken the alarm clock time displaying section.

It is also known to provide a light sensor, such as a cadmium sulfide photosensor, which detects ambient light. The illumination of the time displaying section of the alarm clock is thus controlled depending on the ambient light detected by the photosensor. Therefore, when the room is dark, such as at night, the photosensor detects a dark condition and the time displaying section is illuminated so that it is visible in the dark room. If the alarm clock is battery operated, the battery will not unnecessarily drain during light conditions, when there is no need for illumination of the time displaying section.

If an illumination switch is used to turn the illumination of the time displaying section on and off, the user must either leave the illumination of the time displaying section on (which may cause trouble to the user while trying to get to sleep), or the user must manually shut the illumination switch off. However, if the user does manually shut the illumination switch off, it must then be manually turned on again in order to observe the time displaying section in a darkened room. Therefore, if the user wakes up at night and wishes to know what time it is, the illumination switch must be first found, and then switched on in the dark.

On the other hand, if the alarm clock has a photosensor, since the illumination of the time displaying section is kept turned on when the room is dark, the battery will be drained unnecessarily to provide the illumination. Also, since the time displaying section is illuminated whenever the room is dark, the illumination may bother the user while trying to fall asleep.

SUMMARY OF THE INVENTION

The present invention has been devised to overcome the drawbacks of the conventional art.

It is an object of the present invention to provide an alarm clock having a display section that is illuminated during appropriate predetermined times, and only when ambient light is detected to be below a predetermined level.

It is another object of the present invention to provide an alarm clock having a display section that is illuminated at appropriate predetermined times, only when an alarm set switch is switched to an alarm on condition and the detected ambient light is below a predetermined level.

It is still another object of the present invention to provide an alarm clock having a display section that is illuminated during a predetermined time zone before an alarm time, only if the detected ambient light is below a predetermined level and an alarm set switch is switched to an alarm on condition.

It is a further object of the present invention to provide an alarm clock having a display section that is illuminated during a predetermined time zone before an alarm time, and/or during a time while an alarm sound is being generated, only if the detected ambient light is below a predetermined level and an alarm set switch is in an alarm on condition.

In accordance with the present invention, an alarm clock is provided which generates an alarm sound at a set alarm time. A time displaying section of the alarm clock is illuminated so that it is visible when the ambient light surrounding the alarm clock is low, such as in a dark room and at night.

The alarm clock controls the illumination of the time displaying section depending on the alarm time and the detected ambient light. An alarm set switch is used to switch between an alarm-on and an alarm-off condition. When the alarm clock is set in the alarm-on condition, an alarm sound will be generated when the alarm time is reached. However, if the alarm clock is set in the alarm-off condition, the alarm sound will not be generated when the alarm time is reached. Therefore, if the user does not wish to be woken up by the alarm clock at the set alarm time (such as on the weekends or when the user does not spend the night at home), the alarm clock can be set in the alarm-off condition. The alarm clock thus controls the illumination of the time displaying section so that it is illuminated only when the alarm set switch is set to the alarm-on condition, and the detected ambient light is below a predetermined level.

Furthermore, the illumination of the time displaying section may bother the user while trying to get to sleep. In accordance with the present invention, the illumination is controlled so that after the user sets the alarm set switch to the alarm-on condition, a predetermined amount of time elapses before the time displaying section is illuminated. Thus, the user is not bothered by the illumination light while trying to get to sleep, and once asleep (after elapse of the predetermined amount of time) the display section is illuminated so that if the user should wake up, the time can easily be observed.

In accordance with the present invention, the illumination of the time displaying section is prevented during the times when the alarm set switch is in the alarm-off condition. Thus, after the user wakes up and switches the alarm clock to the alarm-off condition, even if the room becomes dark in the user's absence, the time displaying section will not be unnecessarily illuminated, so that battery power can be conserved.

Furthermore, in accordance with the present invention, the illumination of the time displaying section can be controlled so that it is illuminated during a predetermined time zone before the set alarm time, and also while the alarm sound is being generated, but only if the detected ambient light is below a predetermined level and the alarm set switch is in the alarm-on condition. In this case, the time displaying section will continue to be illuminated until the user wakes up and shuts off the alarm sound.

Also, the illumination can be controlled so that the time displaying section continues to be illuminated for a predetermined amount of time after the alarm sound has been generated, so that the user can observe the time while getting ready for work, etc. Once the predetermined amount of time after the alarm sound generation is stopped has elapsed, the illumination of the time displaying section is discontinued, so that battery power can be conserved.

In accordance with the present invention, the illumination of the time displaying section can be controlled so that it is illuminated only while the alarm sound is being generated. In this case, illumination light from the displaying section will not bother the user while sleeping, and both the light from the time displaying section and the alarm sound can be used to awaken the user from sleep.

DETAILED DESCRIPTION OF THE INVENTION

Figure 1:
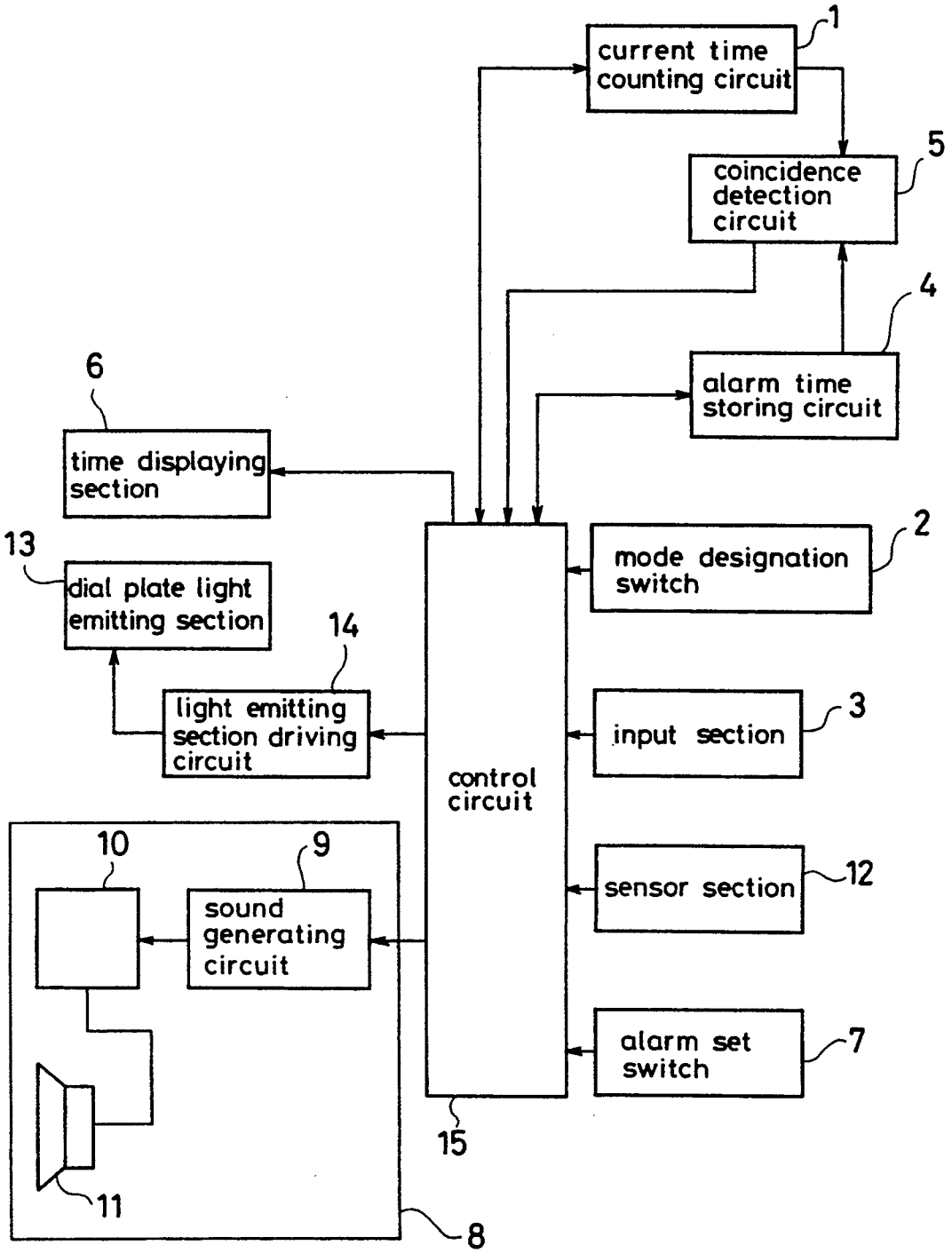
FIG. 1 is a block diagram showing an embodiment of an alarm clock in accordance with the present invention.

Referring to FIG. 1, in accordance with one embodiment of the present invention, a current time counting circuit 1 is composed of a quartz oscillator, dividers, etc. and counts the current time and calendar information (such as month, day and year). A mode designation switch 2 is used to designate various modes of operation of the alarm clock, such as current time setting mode, alarm time setting mode, calendar mode, etc. An input section 3 is used to set the current time, alarm time and calendar information, depending on the mode designated through the mode designation switch 2. An alarm time storing circuit 4 which includes a RAM stores an alarm time that is set by the input section 3.

A coincidence detection circuit 5 outputs a coincidence signal when the current time information counted by the current time counting circuit 1 coincides with the alarm time information stored in the alarm time storing circuit 4. Stated otherwise, the coincidence detection circuit 5 determines when the current time reaches the set alarm time and outputs a coincidence signal in response to such detection.

A time displaying section 6 displays the current time, the alarm time or the calendar information, depending on the mode designated by the mode designation switch 2. The time displaying section may be an analog time displaying device, or a digital time displaying device. In the case of a digital time displaying device, a liquid crystal display (LCD) can be used.

An alarm set switch 7 is used for switching between an alarm-on and an alarm-off condition. An alarm unit 8 generates an alarm sound when it is determined that the current time and the alarm time coincide. The alarm unit 8 preferably comprises a sound generating circuit 9, an amplifier 10 and a speaker 11. The alarm sound is generated only when the alarm set switch 7 is switched to the alarm-on condition. The alarm sound signal is outputted from the sound generating circuit 9 either for a predetermined time period (for example, 5 minutes) or until the alarm set switch 7 is switched to the alarm-off condition. Alternatively, a snooze switch (not shown) may be provided for delaying the time that the alarm sound is generated when it is activated by the user.

A sensor section 12 detects the amount of ambient light. The sensor section 12 may be, for example, a cadmium sulfide photosensor. Illuminating means in the form of a dial plate light-emitting section 13, which may, for example, be composed of an electroluminesence plate, illuminates the analog and/or digital time displaying device of the time displaying section 6. The dial plate light-emitting section 13 is activated by a light emitting section driving circuit 14. A control circuit 15 composed of a CPU, ROM, RAM, etc. controls the various operations of the alarm clock.

Figure 2:
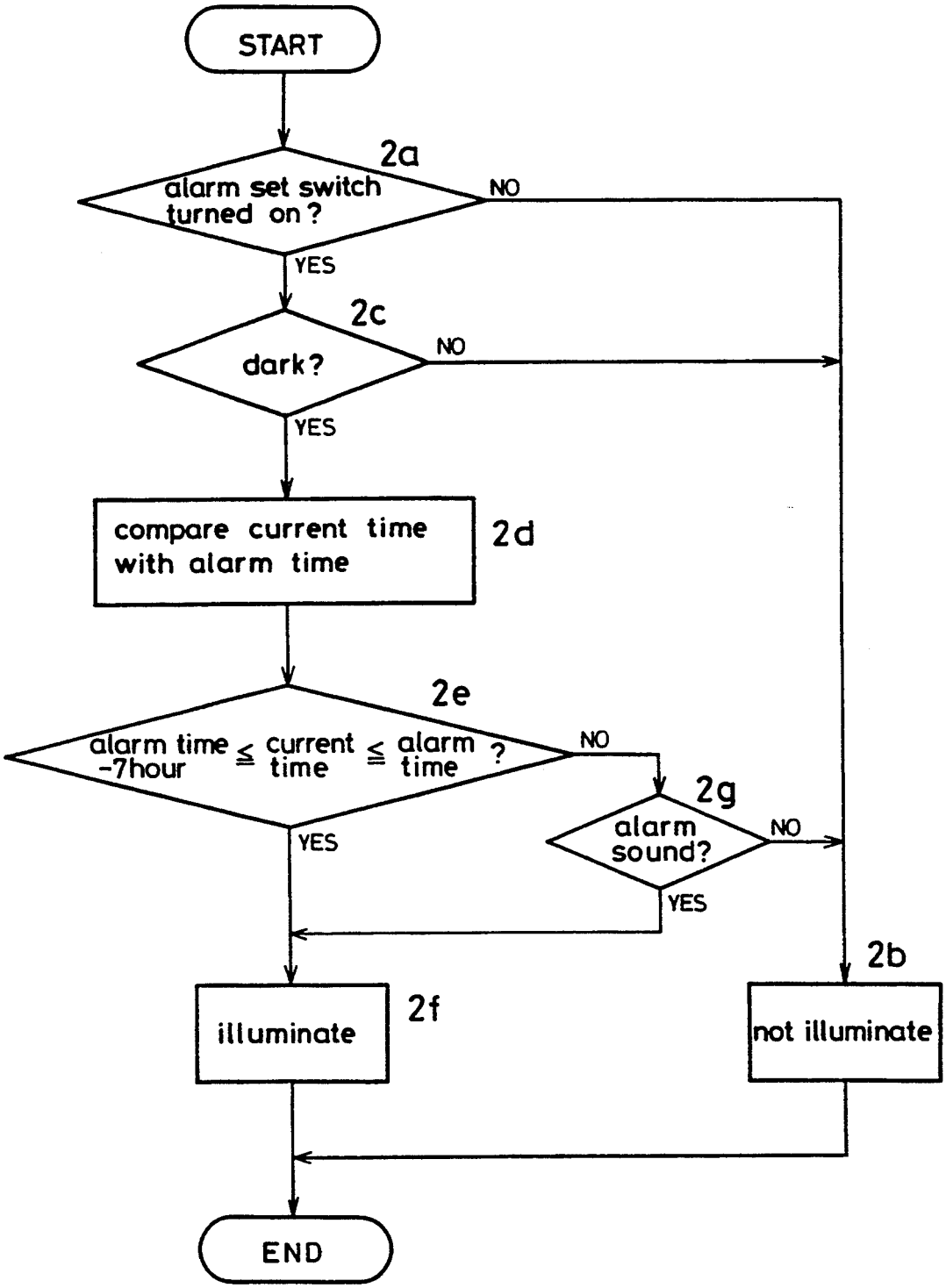
FIG. 2 is flow chart for describing the operation of the alarm clock shown in FIG. 1.

FIG. 2 is a flow chart which describes the operation of the embodiment of the alarm clock shown in FIG. 1. In accordance with the present invention, an alarm time is set and stored in the alarm time storing circuit 4. For example, if the user wishes the alarm to sound at 6:00 a.m., then the alarm time information 6:00 a.m. is stored in the alarm time storing circuit 4.

The control circuit 15 determines when the alarm set switch 7 is in the alarm-on condition (step 2a). If the alarm set switch 7 is turned off, that is, in the alarm-off condition, the control circuit 15 controls the light-emitting section driving circuit 14 to turn off the dial plate light-emitting section 13 and thus the time displaying section 6 is not illuminated. However, if the control circuit 15 determines that the alarm set switch 7 is turned on, that is, set in the alarm-on condition, then the ambient light level detected by the sensor section 12 is checked (step 2c). If the ambient level is above a predetermined level (not dark), then the control circuit 15 proceeds to step 2b, and the time displaying section 6 is not illuminated. However, if the detected ambient light is below a predetermined level (dark), then the control circuit 15 compares the current time information counted by the current time counting circuit 1 with the alarm time information stored in the alarm time storing circuit 4 (step 2d).

The control circuit 15 controls the light-emitting section driving circuit 14 to turn on the dial plate light-emitting section 13 to illuminate the displaying section 6 during a predetermined time zone before the alarm time stored in the alarm time storing circuit 4. As shown in step 2e, in accordance with the example shown in FIG. 2, if the current time is within a prescribed time zone within 7 hours before the alarm time (alarm time minus 7 hours), then the time displaying section 6 will be illuminated (step 2f). In the example, the predetermined time zone is between 11:00 p.m. (7 hours before 6:00 a.m.) and 6:00 a.m. (the alarm time stored in the alarm time storing circuit 4). Thus, in accordance with the present invention, if it is assumed that the user sleeps for 8 hours a night, then for the first hour after the user goes to bed the time displaying section 6 will not be illuminated, so the illumination light does not interfere with the user getting to sleep. However, for the remaining 7 hours, the time displaying section 6 is illuminated, so that if the user awakens during the night, the time is easily observable.

The control circuit 15 also controls the light-emitting section driving circuit 14 to turn on the dial plate light-emitting section 16 and illuminate the time displaying section 6 while the alarm sound is being generated (step 2g). Thus, in accordance with this mode of operation, even though the current time is not within the predetermined time zone, the time displaying section 6 remains illuminated while the alarm sound is being generated, so the user can observe the time before the alarm set switch is switched to the alarm-off condition.

Figure 3:
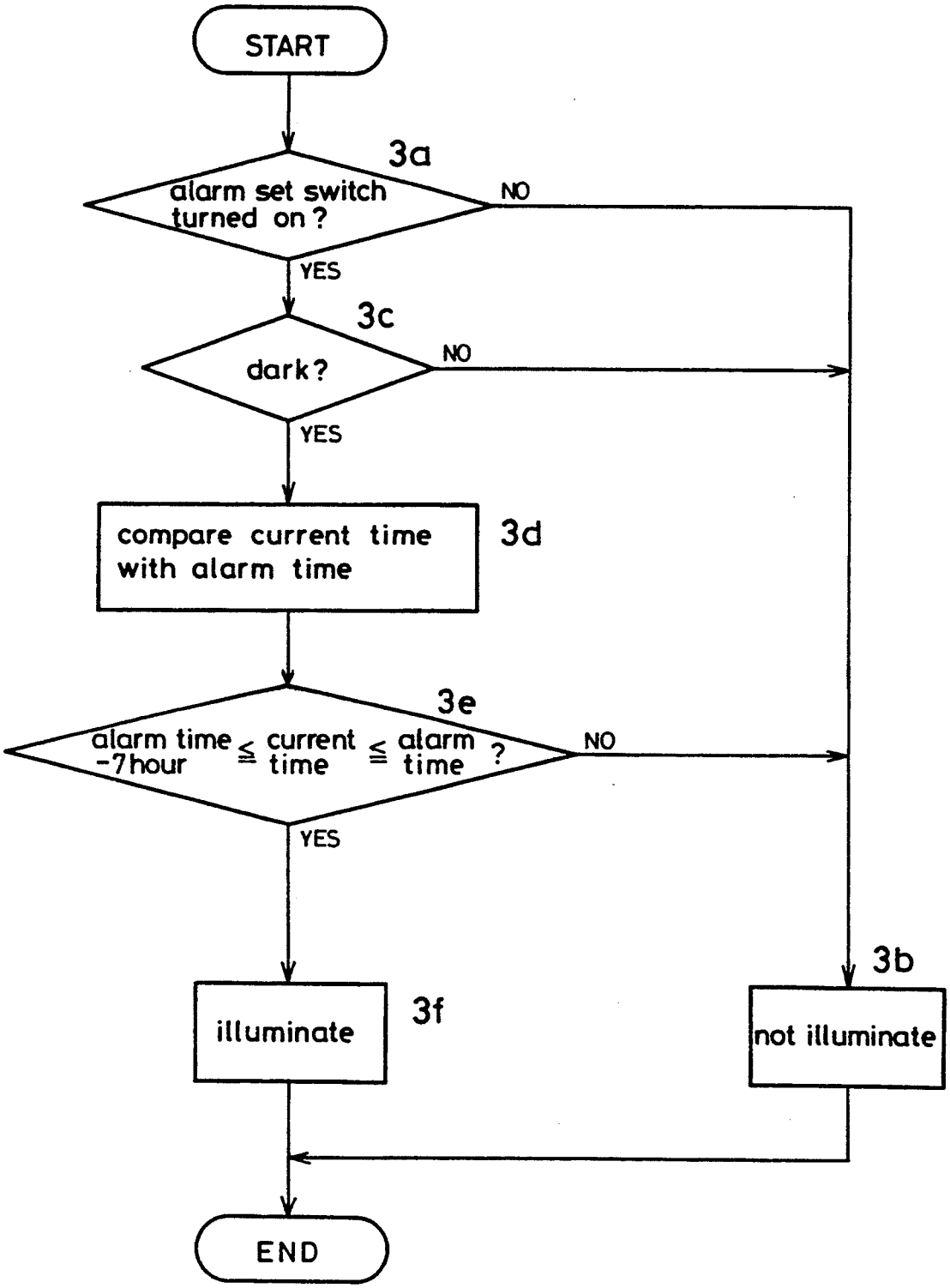
FIG. 3 is a flow chart for describing the operation of a modified embodiment of the alarm clock shown in FIG. 1.

FIG. 3 shows the operation of a modified embodiment of the alarm clock shown in FIG. 1, which is similar to the operation shown in FIG. 2 except that the time displaying section 6 is not illuminated during the sounding of the alarm. In accordance with this modification, the control circuit 15 controls the light-emitting section driving circuit 14 to turn on the dial plate light-emitting section 13 to illuminate the time displaying section 6 only during a predetermined time zone before the alarm time (step 3e). In this mode of operation, once the alarm time has been reached, the light-emitting section driving circuit 14 is controlled so as not to provide illumination of the time displaying section 6.

In accordance with the above operations described with reference to FIGS. 2 and 3, the time displaying section 6 is illuminated when the alarm set switch 7 is switched to the alarm-on condition, the current time is within a time zone within 7 hours before the alarm time, and the detected ambient light is below a predetermined level. However, the predetermined time zone in which the illumination is enabled can be changed to include any length of time depending on the user's preference.

Figure 4:
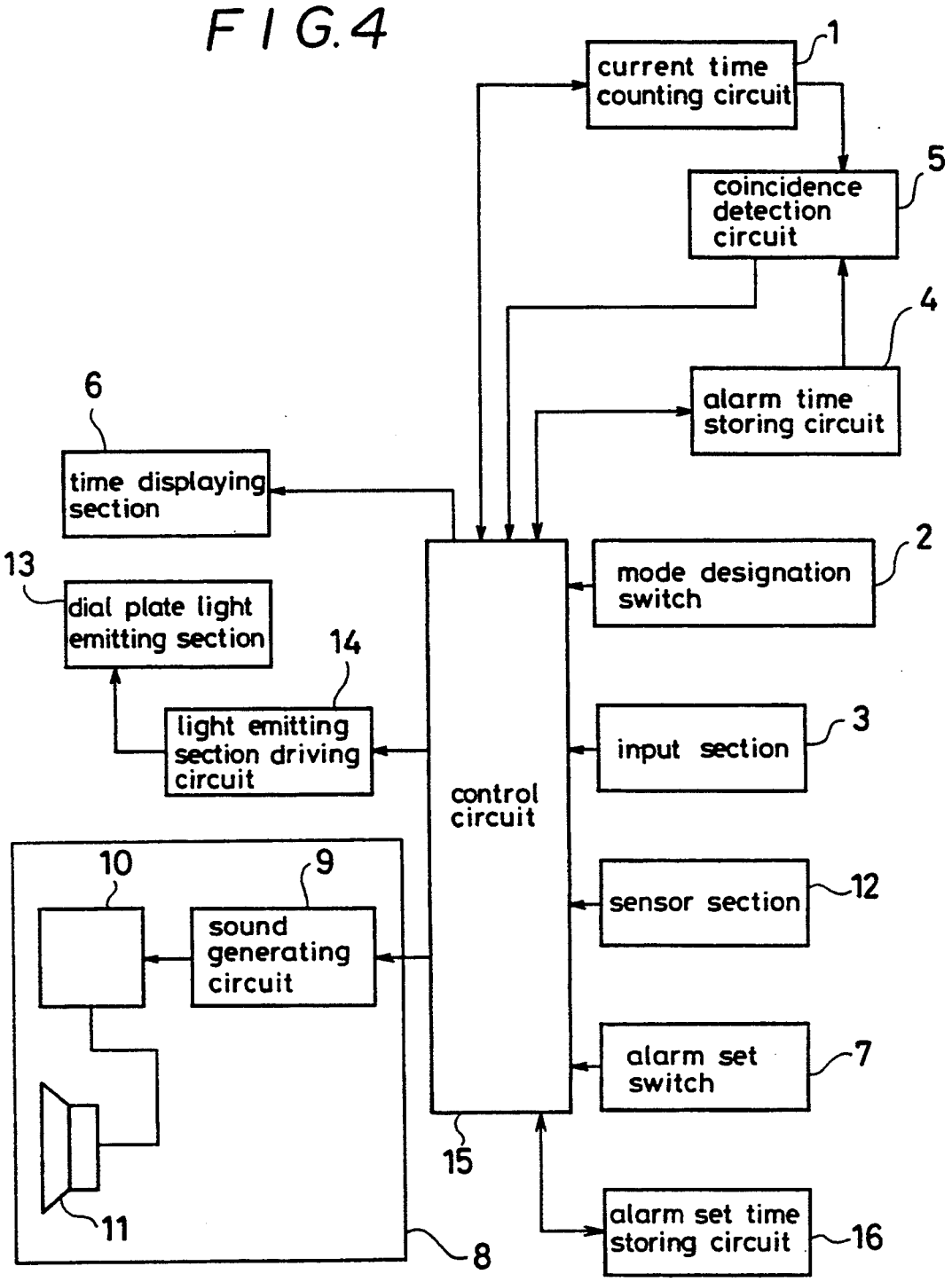
FIG. 4 is a block diagram showing another embodiment of an alarm clock in accordance with the present invention.

Another embodiment of the inventive alarm clock is shown in FIG. 4. In this embodiment, the illumination of the time displaying section 6 is enabled after a predetermined time has elapsed after the alarm set switch 7 has been switched to the alarm-on condition. In FIG. 4, the same reference numerals are used to denote the same parts shown in FIG. 1. However, as shown in FIG. 4, in this embodiment, an alarm set time storing circuit 16 is provided for storing the time at which the alarm set switch 7 is switched to the alarm-on condition.

Figure 5:
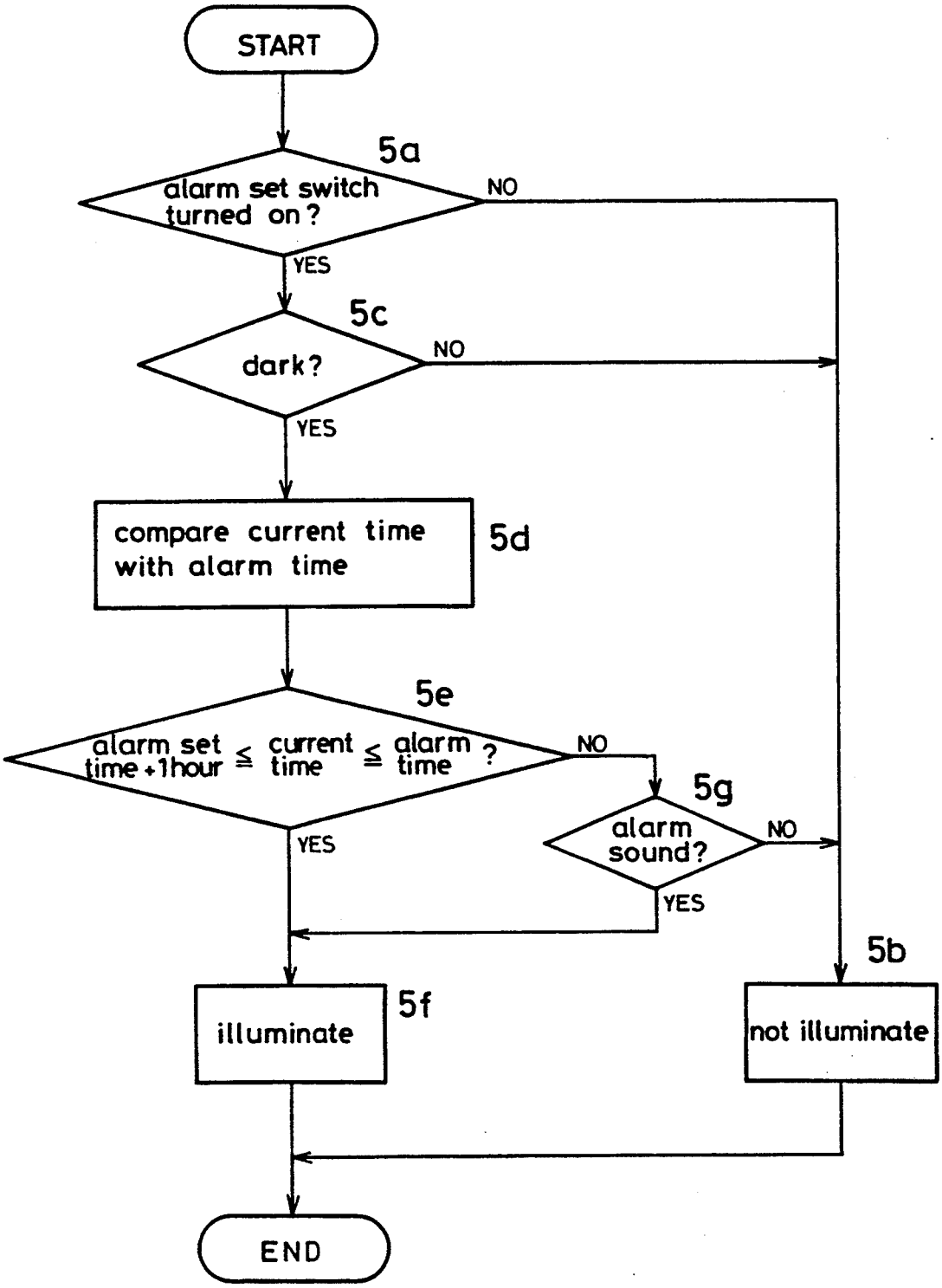
FIG. 5 is a flow chart for describing the operation of the alarm clock shown in FIG. 4.

Referring to FIG. 5, the operation of the embodiment shown in FIG. 4 will be described. For illustrative purposes, it is assumed that 6:00 a.m. is stored in the alarm time storing circuit 4 as the alarm time information. Of course, any desired alarm time information can be set depending on the user's preference. Also for illustrative purposes, it is assumed that the user has switched the alarm set switch 7 to the alarm-on condition at 11:20 pm. Therefore, the alarm set time information 11:20 p.m. is stored in the alarm set time storing circuit 16 as the time at which the alarm set switch 7 has been switched to the alarm-on condition.

If the control circuit 15 determines that the alarm set switch 7 is turned off (step 5a), that is, in the alarm-off condition, then the control circuit 15 controls the light-emitting section driving circuit 14 to turn off the dial plate light-emitting section 13 (step 5b). If the control circuit 15 determines that the alarm set switch 7 is in the alarm-on condition (step 5a) but the output of the sensor section 12 indicates a bright condition (ambient light above a predetermined level) (step 5c), then the control circuit 15 controls the dial plate light-emitting section 13 so that the time displaying section 6 is not illuminated (step 5b). However, when the alarm set switch 7 is in the alarm-on condition (step 5a) and the sensor section 12 indicates a dark condition (ambient light below a predetermined level) (step 5c), the control circuit 15 controls the illumination of the display section so that it is illuminated if the current time counted by the current time counting circuit 1 is within a time zone which, in this example, is within 1 hour after the alarm set switch 7 has been switched to the alarm-on condition (steps 5d, 5e and 5f).

Stated otherwise, the control circuit 15 controls the illumination so that the display section is illuminated during a predetermined time zone between a time when the alarm set switch 7 is switched to the alarm-on condition and the alarm time, but only if the detected ambient light is below a predetermined level and the alarm set switch is in the alarm-on condition. In the example illustrated in FIG. 5, the prescribed time zone is between 12:20 a.m. (1 hour after 11:20 p.m.) and 6:00 a.m. (the alarm time stored in the alarm time storing circuit 4).

If the current time is not within the predetermined time zone when the alarm sound is being generated (step 5g), the control circuit 15 controls the illumination of the displaying section 6 so that it is illuminated while the alarm sound is being generated (step 5f). If the alarm sound is not being generated and the current time is not within the predetermined time zone (for example, after the set alarm time), then it assumes that the user has woken up and the time displaying section 6 is not illuminated. Thus, in accordance with this mode of operation, the time displaying section 6 will not be illuminated for a period of time (1 hour) after the user switches the alarm set switch 7 to the alarm-on condition. In this manner, during the 1 hour period at the beginning of the user's sleep, the light will not disturb the user and the user will not be troubled in falling asleep. However, if the user should wake up during the night and wish to observe the time, the time displaying section 6 will be illuminated.

Figure 6:
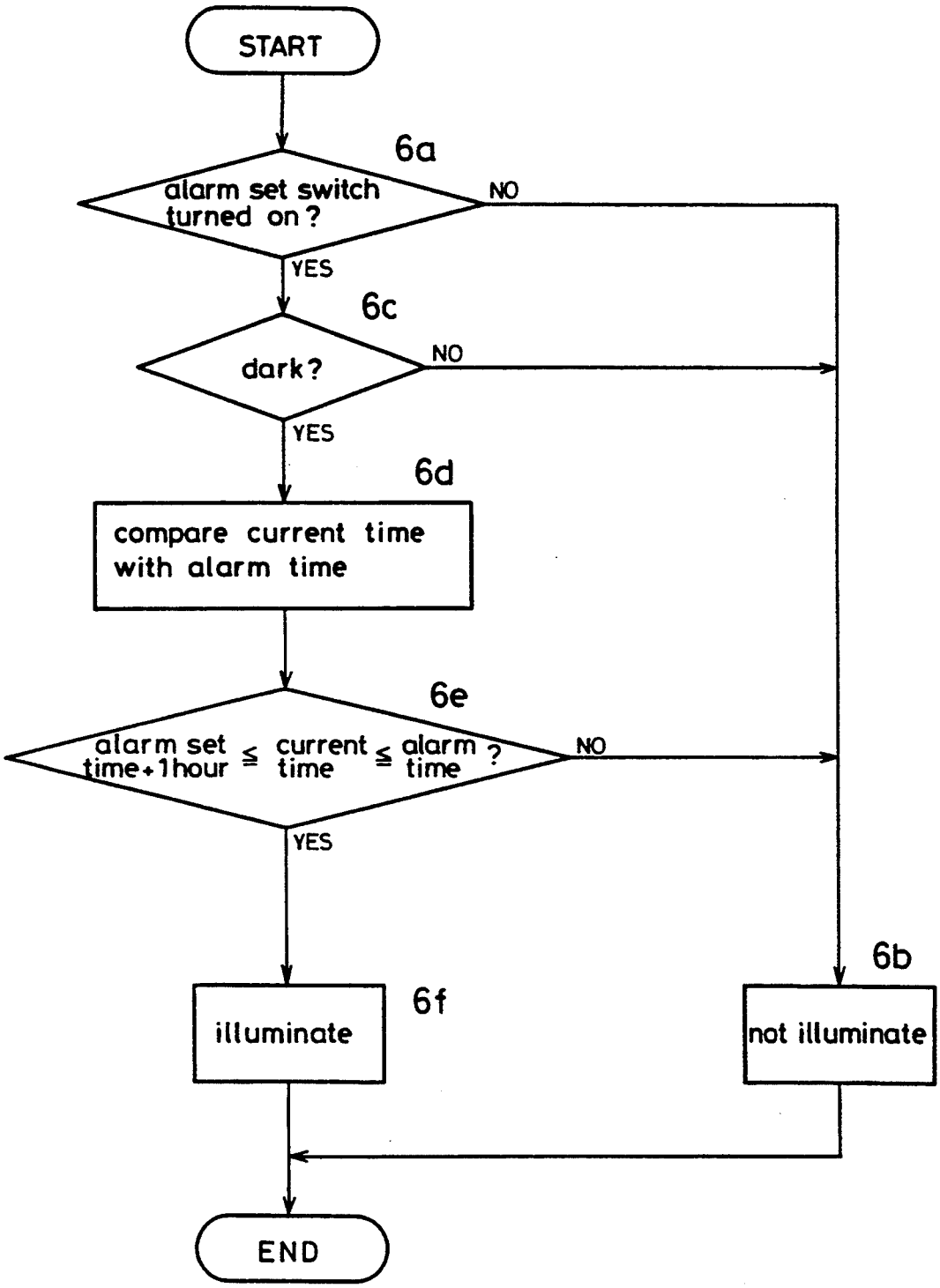
FIG. 6 is a flow chart for describing the operation of a modified embodiment of the alarm clock shown in FIG. 4.

FIG. 6 shows the operation of a modified embodiment of the alarm clock shown in FIG. 4, wherein the time displaying section 6 is not illuminated during the time that the alarm sound is being generated. In this case, the operation is the same as that described in FIG. 5, except that if it is determined that the current time is not within the predetermined time zone (step 6e), then the time displaying section 6 will not be illuminated (step 6b) even though the alarm sound is being generated.

In the FIG. 4 embodiment, of the present invention, it is noted that the predetermined time zone can be adjusted depending on the user's preference. For example, the user may wish to extend the time after the alarm set switch 7 has been switched to the alarm-on condition before the time displaying section 6 is illuminated.

The present invention overcomes the drawbacks of the conventional art by providing an alarm clock having an improved illuminated time displaying section 6. In accordance with the invention, the time displaying section 6 is illuminated under the following conditions; (1) if the ambient light is detected to be above a predetermined level, the time displaying section 6 is not illuminated thus conserving energy, and (2) if the alarm set switch 7 is switched to the alarm-on condition, then the time displaying section 6 is illuminated during a time within a predetermined time zone. This results in the advantages that energy can be conserved, illumination light does not bother the user as he tries to get to sleep, and the user can readily observe the time if he wakes up during the night.

We claim:

1. An alarm clock, comprising: a time displaying section for displaying time information; alarm setting means for setting an alarm time; controllable illuminating means for illuminating the displaying section; detecting means for detecting ambient light; and controlling means for controlling the illuminating means to illuminate the displaying section depending on both the alarm time and the detected ambient light.

2. An alarm clock according to claim 1; including an alarm set switch for switching between an alarm-on and an alarm-off condition; and wherein the controlling means includes means for determining if the alarm set switch is in the alarm-on condition, and means for controlling the illuminating means to illuminate the displaying section depending on the alarm-on condition, the alarm time and the detected ambient light.

3. An alarm clock according to claim 1; including an alarm set switch for switching between alarm-on and alarm-off conditions; and wherein the controlling means includes means for determining if the alarm set switch is in the alarm-on condition, and means for controlling the illuminating means to illuminate the displaying section during a predetermined time zone before the alarm time only if the detected ambient light is below a predetermined level and the alarm set switch is in the alarm-on condition.

4. An alarm clock according to claim 1; including an alarm set switch for switching between alarm-on and alarm-off conditions; and means for generating an alarm sound at the alarm time; and wherein the controlling means includes means for determining if the alarm set switch is in the alarm-on condition and for determining when the alarm sound is being generated, and means for controlling the illuminating means to illuminate the displaying section during a predetermined time zone before the alarm time only if the detected ambient light is below a predetermined level and the alarm set switch is in the alarm-on condition, and for controlling the illuminating means to illuminate the displaying section during a time while the alarm sound is being generated only if the detected ambient light is below a predetermined level and the alarm set switch is in the alarm on condition.

5. An alarm clock according to claim 1; including an alarm set switch for switching between alarm-on and alarm-off conditions; and means for generating an alarm sound at the alarm time; and wherein the controlling means includes means for determining if the alarm set switch is in the alarm-on condition and for determining when the alarm sound is being generated, and means for controlling the illuminating means to illuminate the displaying section while the alarm sound is being generated only if the detected ambient light is below a predetermined level and the alarm set switch is in the alarm-on condition.

6. An alarm clock according to claim 1; including an alarm set switch for switching between alarm-on and alarm-off conditions; and wherein the controlling means includes means for determining when the alarm set switch is switched to the alarm-on condition, and means for controlling the illuminating means to illuminate the displaying section during a predetermined time zone between a time when the alarm set switch is switched to the alarm-on condition and the alarm time only if the detected ambient light is below a predetermined level and the alarm set switch is in the alarm-on condition.

7. An alarm clock according to claim 1; including an alarm set switch for switching between alarm-on and alarm-off conditions; and means for generating an alarm sound at the alarm time; and wherein the controlling means includes means for determining when the alarm set switch is switched to the alarm-on condition and for determining when the alarm sound is being generated, and means for controlling the illuminating means to illuminate the displaying section during a predetermined time zone between a time when the alarm set switch is switched to the alarm-on condition and the alarm time and for controlling the illuminating means to illuminate the display section while the alarm sound is being generated only if the detected ambient light is below a predetermined level and the alarm set switch is in the alarm-on condition.

8. An alarm clock according to claim 1; including means for generating an alarm sound at the alarm time; and wherein the controlling means includes means for determining when the alarm sound is being generated, and means for controlling the illuminating means to illuminate the displaying section only while the alarm sound is being generated and only if the detected ambient light is below a predetermined level.

9. An alarm clock, comprising: a time displaying section for displaying time information; alarm setting means for setting an alarm time; alarm time storing means for storing the set alarm time; an alarm set switch for switching between alarm-on and alarm-off conditions; time counting means for counting current time; controllable illuminating means for illuminating the displaying section; detecting means for detecting ambient light; and controlling means for comparing the alarm time stored in the alarm time storing means with the current time counted by the time counting means, for determining if the alarm set switch is in the alarm-on condition, and for controlling the illuminating means to illuminate the displaying section only when the current time is within a predetermined time zone before the alarm time, the alarm set switch is in the alarm-on condition and the detected ambient light is below a predetermined level.

10. An alarm clock according to claim 9; including means for generating an alarm'sound at the alarm time; and wherein the controlling means includes means for determining if the alarm sound is being generated, and means for controlling the illuminating means to illuminate the displaying section during a time while the alarm sound is being generated only if the detected ambient light is below a predetermined level and the alarm set switch is in the alarm-on condition.

11. An alarm clock, comprising: a time displaying section for displaying time information; alarm setting means for setting an alarm time; alarm time storing means for storing the alarm time; an alarm set switch for switching between alarm-on and alarm-off conditions; alarm set time storing means for storing a time when the alarm set switch is switched to the alarm-on condition; time counting means for counting current time; controllable illuminating means for illuminating the displaying section; detecting means for detecting ambient light; and controlling means for comparing the current time with the alarm time and with the time when the alarm set switch is switched to the alarm-on condition, for determining if the alarm set switch is in the alarm-on condition, and for controlling the illuminating means to illuminate the displaying section during a predetermined time zone when the current time is between the time when the alarm set switch is switched to the alarm-on condition and the alarm time only if the alarm set switch is in the alarm-on condition and the detected ambient light is below a predetermined level.

12. An alarm clock according to claim 11; including means for generating an alarm sound at the alarm time; and wherein the controlling means includes means for determining if the alarm sound is being generated, and means for controlling the illuminating means to illuminate the displaying section during a time while the alarm sound is being generated only if the detected ambient light is below a predetermined level and the alarm set switch is in the alarm-on condition.

13. An alarm clock according to claim 11; wherein the predetermined time zone starts after a predetermined time has elapsed since the time when the alarm set switch is switched to the alarm-on condition.

* * * * *